United States Patent [19]

Ko et al.

[11] 4,410,286

[45] Oct. 18, 1983

[54] PRINTING COMPLEX CHARACTERS

[75] Inventors: Elizabeth Y. Ko; Robert A. Pascoe, both of Austin, Tex.

[73] Assignee: International Business Machines Corporation, Armonk, N.Y.

[21] Appl. No.: 273,562

[22] Filed: Jun. 16, 1981

[51] Int. Cl.[3] ..... B41J 25/24

[52] U.S. Cl. ..... 400/22; 400/904; 400/144.2

[58] Field of Search ..... 400/124, 904, 22, 144.2, 400/144.3, 322, 300

[56] References Cited

U.S. PATENT DOCUMENTS

| | | | |
|---|---|---|---|
| 2,800,213 | 7/1957 | Young | 400/22 |
| 3,199,446 | 8/1965 | Schnaf | 400/904 X |
| 3,636,429 | 1/1972 | Jakubowski et al. | 318/685 |
| 3,738,472 | 6/1973 | Willcox | 400/904 X |
| 3,925,787 | 12/1975 | Suzuki | 346/75 |
| 3,947,853 | 3/1976 | Denny et al. | 400/904 X |
| 4,030,591 | 6/1977 | Martin et al. | 400/144.2 |
| 4,178,108 | 12/1979 | Kane | 400/144.2 |
| 4,180,335 | 12/1979 | Yamada | 400/322 X |
| 4,189,246 | 2/1980 | Kane et al. | 400/144.2 |
| 4,307,967 | 12/1981 | Araki et al. | 400/144.3 X |

OTHER PUBLICATIONS

Hurley et al., IBM Tech. Discl. Bulletin, vol. 21, No. 11, Apr. 1979, pp. 4361-4362.

Martin, IBM Tech. Discl. Bulletin, vol. 18, No. 9, Feb. 1976, p. 2825.

*Primary Examiner*—Edward M. Coven

*Attorney, Agent, or Firm*—Andrea P. Bryant

[57] ABSTRACT

There is disclosed an apparatus for and a method of printing complex characters using a high speed bidirectional on-the-fly printer. In accordance with the present method complex characters are printed in at least two steps. Once the first portion of a character has been printed and prior to the printing of the next character the carrier is turned around and again moved past the print position where the remaining portion of the first mentioned character is printed. This approach is termed "double turnaround".

8 Claims, 10 Drawing Figures

ESC DISTANCE
LOOK UP TABLE
CLOCK
OVERSHOOT DISTANCE
RETURN DISTANCE
ADDER 963
CLOCK
LOOK UP TABLE
CED
DPD
Vi
Vf8
Vf9
A
O
I

PRINTING COMPLEX CHARACTERS

BACKGROUND

Technical Field

The present invention relates to impact printers wherein the print member is moved relative to the printing medium and impact printing is carried out at a plurality of print positions along a lateral line on said printing medium by moving said print member so that a selected type character on said print member coincides with a particular print position and then impacting said character against said print medium through a suitable ink release ribbon or sheet.

More specifically, the present invention relates to printing complex characters, that is, those requiring at least one overstrike, using a bidirectional, high speed on-the-fly printer.

Description of the Prior Art

U.S. Pat. No. 3,925,787 discloses operating an ink jet type printer wherein turnaround of the printhead on its carrier occurs so that the carrier is deliberately overshot at the end or at the beginning of a line for a distance such that the carrier will be at its on-the-fly print speed when it reaches the first character to be printed after its direction reversal. There is no teaching of double turnaround for printing a complex character before the next character is printed.

IBM *Techanical Disclosure Bulletin* Vol. 18, No. 9, February 1976, page 2825, describes the method for achieving high speed printing within the confines of a relatively slow character select system by printing only some of the characters in the first pass along a given print line and then reversing the process and printing the remainder of the selected characters along the second pass. There is no teaching of on-the-fly printing of a single complex character in two passes carried out before the next character is printed.

U.S. Pat. No. 4,189,246 refers to printers which utilize a rotating disk with characters on the periphery thereof as being well known. Several such printers are commercially available. Rotating disk printers can be divided in categories by either focusing on how the disk rotates or by focusing on how the carrier traverses.

Focusing on how the disk rotates, such printers can be divided into a first category where the disk constantly rotates and into a second category where the motion of the disk is intermittent. In printers with a constantly rotating disk, printing takes place when the hammer strikes the rotating disk. Rotation of the disk is not stopped each time a character is printed. In printers with a disk that intermittently rotates, the disk is rotated to the desired print position and then stopped. There is no disk rotation while printing takes place.

An alternate division of disk printers can be made by focusing upon the motion of the carrier. In some printers, the traverse of the carrier is stopped each time printing takes place. In other printers the carrier is moving at the instant when printing occurs. In both the type where the carrier is moving when printing occurs and in the type where the carrier is stopped when printing occurs, the disk may or may not be rotating at the time of printing. In some printers where the carrier is moving at a fixed speed when printing takes place, the carrier is slowed down and stopped between print positions in order to give the rotating disk time to move to the desired character.

U.S. Pat. No. 4,178,108 discusses a number of issued patents which relate generally to printers of the type discussed above. That patent teaches moving a carrier from one print position to the next a fixed distance at a variable speed selected in order that the carrier reach the next print position in synchronization with the print disk reaching the next character position. Upon such synchronization the print hammer is fired to print the character while the carriage continues on-the-fly toward the next print position.

U.S. Pat. No. 4,189,246 relates to moving the carrier from one print position to the next at a speed which is selected depending on the time required for the disk to rotate to the next character. Printing takes place with the carrier moving at one of the number of speeds and the force utilized to drive the hammer to print the characters is varied dependent on which character is being printed. Hammer firing for each character is timed dependent on print speed as well as the force utilized to drive the hammer.

None of the prior art references are particular solutions to the problem of printing complex characters which do not appear on the given printwheel petals. This problem arises often times in printing characters for non-English languages and it is not always feasible to change printwheels. Thus, characters may be constructed from characters or symbols appearing on individual petals of the printwheel. For example, often times in computer related descriptions, zeros are indicated by a slashed zero to avoid confusion with the letter "o". Another example is an accented "e" when just one or two words will use such.

Also, a problem arises in optimizing operation of a bidirectional printer where one line ends toward the middle of the page and the next line does not start until the middle of the page so that allowing the print carrier to go all the way to the right margin may be inefficient.

Disclosure of the Invention

It is an object of the present invention to provide an improved means of printing complex characters, overstriking, underscoring in a bidirectional printer.

The present invention provides an improved means of operating high speed on-the-fly bidirectional printers so as to print complex characters. The present invention provides a high speed on-the-fly disk printer which has one motor for controlling the disk and another for controlling carrier movement. As in all mechanical systems, mechanical characteristics of these motors and other related mechanical components impose physical limitations such as maximum speeds, maximum acceleration and maximum deceleration. The present invention is directed to maximizing the performance of the printer by controlling the carrier during the printing of complex characters which involve at least two passes at a given print position.

The present invention eliminates some of the problems mentioned with reference to the prior art above discussed by controlling the carrier to experience turnaround sequences at other than the left or right margins so as to more efficiently print complex characters or to underscore or overstrike a character or to end one line and begin another by causing the carrier to pass a given print position more than once before reaching the margin.

The foregoing and other features and advantages will become apparent from the more particular description of the preferred embodiment of the invention is illustrated in the accompanying drawing.

BRIEF DESCRIPTION OF THE DRAWINGS

FIG. 1 shows the main mechanical components of the present printer. They are shown somewhat schematically since such components are well known and the present invention is directed to the control mechanism for the two stepper motors 3 and 8 and the print hammer 10, and not to the mechanical components per se.

As shown in FIG. 1, a laterally sliding carrier 1 is mounted on a guide rod 1*a* and a lead screw 7 and carries a rotatable print wheel or disk 2 driven by a stepping motor 3. The carrier 1 is driven by lead screw 7 which is driven by a stepping motor 8. Alternatively, motor 8 could drive a belt which in turn could drive carrier 1.

Figure 1:
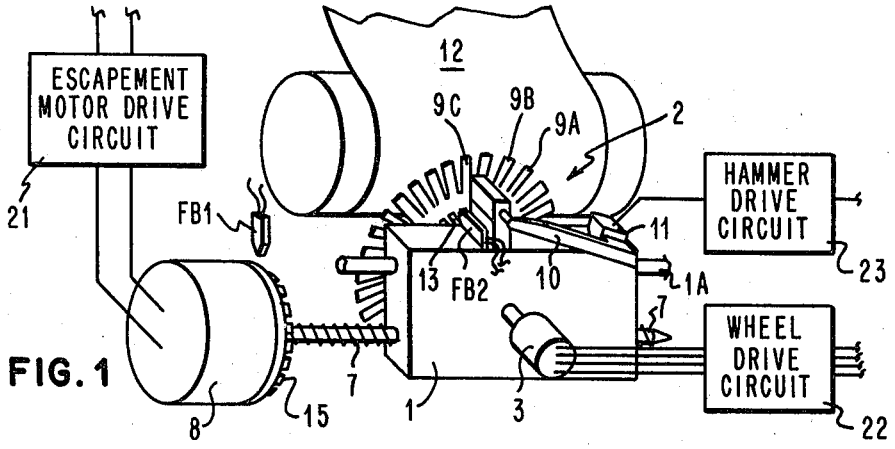
FIG. 1 shows a printer apparatus adapted for use with the present invention.

A type disk 2 comprises a disk having a number of movable type elements such as the flexible spokes or petals or fingers 9A, 9B, 9C, etc. Printing of any desired character is brought about by operating a print hammer 10, which is actuated by a solenoid 11, both of which are mounted on carrier 1. When the appropriate type finger approaches the print position, solenoid 11 actuates hammer 10 into contact with the selected type finger, driving it into contact with a paper 12 or other printing medium. An emitter wheel 13 attached to and rotating with type disk 2 cooperates with a magnetic sensor FB2 to produce a stream of emitter index pulses for controlling the operation of the printer. The emitter has a series of teeth each of which correspond to one petal or finger 9A, 9B, 9C, etc. A homing pulse is generated for each revolution of the print wheel by a single tooth on another emitter (not shown). The printer controls can thus determine the angular position of type disk 2 at any time by counting the pulses received since the lost homing pulse. A toothed emitter 15 is mounted on the shaft of the motor 8 and in conjunction with a transducer FB1 provides pulses which indicate the position of the carrier 1.

Stepper motors 3 and 8 are activated by conventional drive circuits 21 and 22. Examples of the type of drive circuitry that could be used are shown in U.S. Pat. No. 3,636,429. A hammer solenoid 11 is actuated by a hammer drive circuit 23 which is also conventional.

The actions of positioning the carrier 1 and positioning the print wheel 2 are, in general, independent except that coordination is required at the instant printing occurs. Both type disk 2 and carrier 1 must be in a selected position (but they need not be at rest) when hammer 10 strikes type disk 2.

Figure 2:
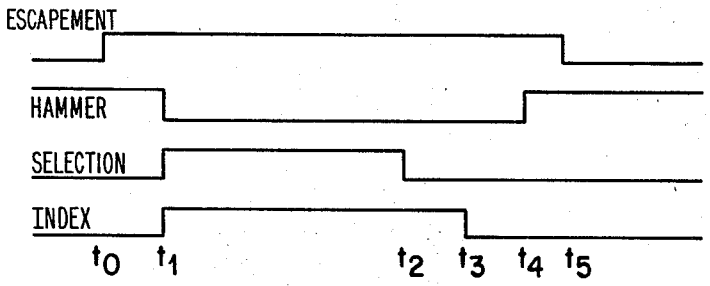
FIG. 2 is a timing chart illustrative of the print cycle in the printer embodying the present invention.

FIG. 2 shows the timing required in a print cycle which is defined as those functions required to print a character including the activity required to move the carrier from a center line or print point of one character to the print point of the next character, select the character to be printed and fire the hammer.

As set out in U.S. Pat. No. 4,030,591, the motion of the carrier can be chosen to move at a plurality of different velocities depending upon the character selection of the print wheel and, thus, the time required for the print wheel to move between adjacent characters. In that patent, four different velocities are utilized for the carriage and for purposes of illustrating this invention, the movement of carriage 1 will likewise be at a velocity chosen among four separate velocities, v1, v2, v3, and v4. For purposes of illustration of this invention, it is assumed that velocity v1 will be the slower of the velocities, velocity v2 faster than v1, velocity v3 faster than v2 and v1, and velocity v4 the fastest velocity. Thus, by selecting the fastest velocity at which the carrier can move for any selected change in position of print wheel 2 as it moves between successive characters (or spaces is such are in the sequence of characters to be printed), then the printing speed of the printer can be maximized.

Refer now to FIG. 2. At $t_o$ escapement starts. At $t_1$, the hammer has completed its previous strike and issues a start command to character selection and index functions. At $t_2$ character selection function is completed. At $t_3$, indexing is completed. At $t_4$ the escapement logic issues a synchronization pulse to the hammer logic so that at $t_5$ the hammer impacts the printwheel concurrently with the completion of escapement.

The maximum time required for selection and indexing in a given system are known; however, the carrier is capable of escaping at a varying rate as earlier discussed. However, the duration of these character selection and indexing times is dependent upon the number of positions that the selection device must be moved and/or the index device stepped. To maximize throughput it is desired that escapement occur at the highest possible rate while maintaining the relationship shown in FIG. 2.

Escapement control sequences are designed under several constraints, one of which is that character selection must be completed before the carrier reaches the print point. The other is the time required to complete a vertical index. As shown in FIG. 2, vertical indexing requires more time. As will be later described, the parameters are chosen to provide the highest print speeds where no indexing takes place. All escapement is completed by the end of character select time. Still further, escapement velocity should be constant prior to the carrier reaching its worst case hammer synchronization point, that point at which hammer fire must start. Further, carrier motion may not stop in an on-the-fly printer. This technique of velocity determination is disclosed in more detail in pending U.S. patent application "Apparatus For Synchronizing Carrier Speed And Print Character Selection In On-The-Fly Printing", Ser. No. 053,678, filed June 29, 1979, assigned to same assignee as the instant application.

Variations can occur in the standard print cycle shown in FIG. 2. These are occasioned by large escapement distances, a change in direction of escapement, or a very small escapement. When a large escapement occurs between two print points, it is more efficient to tab which involves accelerating the escapement to a velocity higher than that used for printing and then returning to print velocity before reaching the print point.

The escapement control sequences which change the direction of carrier movement are of particular interest in printing using the present invention. These changes in direction are required when printing the next line of text in the opposite direction or when overstriking text on the current line, or when building a complex character. Once again, the constraints of (a) selection complete, (b) constant velocity, and (c) on-the-fly printing apply to escapement control sequences involving a change in escapement direction. Actually, at some point, carrier velocity does momentarily reach zero, but this is the result of direction change only.

FIGS. 3–6 illustrate four turnaround sequences by showing what happens to carrier velocities as a function of escapement distances. Escapement distances, for our purposes, are divided into three classification: small, medium and large as a function of the turnaround and accumulated horizontal displacement. The small escapement is one between zero and 6/120's of an inch (0.127 cm). Similarly, medium displacements are those between 6/120's and 42/120's of an inch (0.127 cm and 0.889 cm). Large displacements are those greater than 42/120's (0.889 cm) of an inch. These distances are dependent upon the instant implementation and can vary with implementation.

Figure 3:
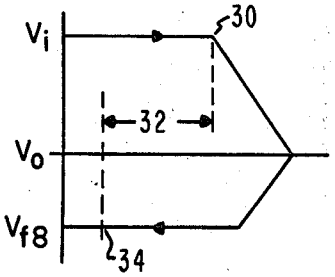
FIG. 3 illustrates a turnaround without overshoot sequence.

Referring now to FIG. 3, velocity is represented on the vertical axis and escapement distance on the horizontal axis in FIG. 3 which represents a turn around without overshoot with a vertical index. At the start of the sequence the carrier is travelling at velocity $v_i$ and printing occurs at print point 1 indicated at 30. The distance 32 between print point 1 and print point 2 indicated at 34 is in the medium to large range. The carrier velocity passes through zero in turning around and eventually reaches its final velocity $v_f$ which is less than or equal to its initial velocity. In this case, deceleration of the carrier, or turnaround, may begin immediately following the printing at position 30. To meet the aforementioned constraints on escapement control, the value of $V_{f8}$ is varied. The lower this velocity, the longer the duration of the sequence, thus allowing a longer selection rotation.

Figure 4:
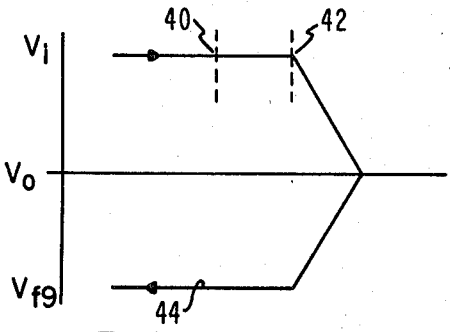
FIG. 4 illustrates a turnaround with overshoot sequence.

In FIG. 4, the turnaround sequence with vertical index including overshoot is illustrated. The need for overshoot occurs where print point 1 and print point 2 are quite close, that is, their escapement range is small. Thus, from print point 1 indicated at 40, the carrier advances for the overshoot distance which is between print point 1 and the point indicated at 42 before showing down to zero and reversing direction to build up again to its final fixed velocity at print point 2 indicated at 44. Variations in the overshoot distance are thus solely used to control the duration of the escapement sequence and therefore allow the aforementioned constraints to be met.

Figure 5:
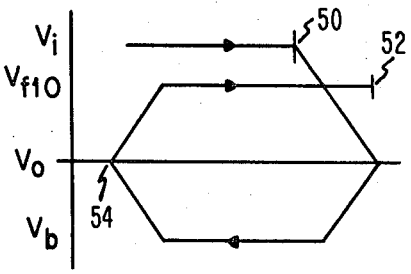
FIG. 5 illustrates a loop sequence.

Shown in FIG. 5 is a loop sequence in which there is no net direction change but print point 1 at 50 and print point 2 at 52 are separated by a distance in the previously defined small range. The loop is required as the lowest escapement velocity $v_i$ does not provide a duration long enough to meet the aforementioned constraints. The initial velocity $v_i$ which the carrier is travelling is allowed to decrease to zero ($v_0$) and the carrier travels at a constant backward velocity $v_b$ in the opposite direction and accelerates after once again changing direction to a final velocity $v_{f10}$ which is, as shown, less than the initial velocity. For this sequence, the final and backward velocities, $v_{f10}$ and $v_b$, are fixed and are not determined as a function of the initial velocity, $v_i$. The distance travelled in the backward direction varies as a function of $v_i$. This is the distance to the farthest point 54 in reverse travel. It is the only variable in this example.

Figure 6:
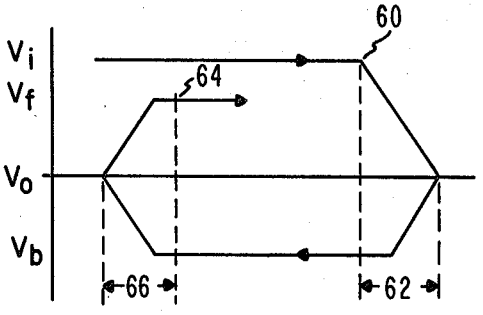
FIG. 6 illustrates a double loop sequence.

FIG. 6 illustrates a double turnaround sequence. The double turnaround sequence is actually a composite of the turnaround with and turnaround without overshoot sequences illustrated in FIGS. 4 and 3, respectively. This sequence is required when the print point 2 at 64 is passed by carrier when accessing print point 1 at 60. That is, the carrier must change direction following printing at print point 1 to access print point 2. This sequence is required regardless of the distance between the two print points. Print point 1 at 60 is first passed by the carrier travelling at its initial velocity $v_i$. Carrier velocity decreases to zero over the distance indicated at 62; and as the direction changes, it accelerates to a constant velocity $v_b$ in overshooting the second print point indicated at 64 by the distance indicated at 66 and then reverses direction passing through $v_o$. The carrier then acclerates to its final fixed velocity $v_f$ which is equal to $V_b$ in time to print at 64. Thus, the only variable is the overshoot distance 66.

As has been shown, each escapement control sequence contains a variable parameter used to vary the time it takes to execute that particular sequence. In addition, these variables are affected by the maximum time required for vertical indexing and character selection in the printer.

In a bidirectional printer embodying our invention, the selection of the above described sequences is made as a function of distance and direction the carrier must travel between the print points, the initial direction in which the carrier is travelling, and the direction that carrier must be travelling to reach the second print point and finally, the desired print direction at the second print point. When the type of sequence required has been determined, which determination may be done as a straight forward table lookup function, as will later become more clear following a discussion of Table I, an appropriate sequence generator is called. The sequence generator logic will be discussed with reference to FIG. 7.

Of the four sequences illustrated in FIGS. 3–6, each one is a function of a particular variable. In FIGS. 3–6 the characteristics of these turnaround sequences were shown in terms of velocity as a function of carrier position. Obviously, within the specific sequence, control to meet given conditions can be done by varying these variables. For the sequence shown in FIG. 3, the turnaround without overshoot, the final escapement velocity is a function of the initial velocity, the distance between print points and the time required for a vertical index. The sequence shown in FIG. 4, turnaround with overshoot, the overshoot distance chosen is chosen as a function of the initial velocity of the carrier and time required for a verticle index. In FIG. 5, the loop turnaround sequence, the backward escapement distance is a function of the initial velocity and index. Finally in FIG. 6, the double turnaround sequence varies as the variable in the turnaround with overshoot sequence since it is, in fact, a combination of this sequence and the turnaround without overshoot sequence.

TABLE I

| | Current Direction | Accumulated/ Required Direction | Desired Print Direction | Action Required |
|---|---|---|---|---|
| Case 1 | F | F | F | No turn- |
| Case 2 | R | R | R | around |
| Case 3 | F | R | R | Single |
| Case 4 | R | F | F | turn- around Trailing* |
| Case 5 | F | F | R | Single |
| Case 6 | R | R | F | turn- around Leading** |
| Case 7 | F | R | F | Double |
| Case 8 | R | F | R | turn- around |

*Single turnaround trailing = a change in escapement direction followed by an escape to the required printpoint.
**Single turnaround leading = an escapement to the printpoint followed by a change in escapement direction.
R = Reverse direction.
F = Forward direction.

Similar sequences as described with reference to FIGS. 3–6 can also be characterized in other terms which are the current direction of the escapement at print point 1, the accumulated or required escapement direction from print point 1 to print point 2, and the desired print direction of print point 2. Table I lists the actions required for these three variables. No turnaround, single turnaround trailing, single turnaround leading, and double turnaround are the four possible actions. In Table I, the forward print direction or escapement direction of left to right is indicated by "F", the reverse direction refers to right to left escapement direction and is indicated by "R".

Figure 10:
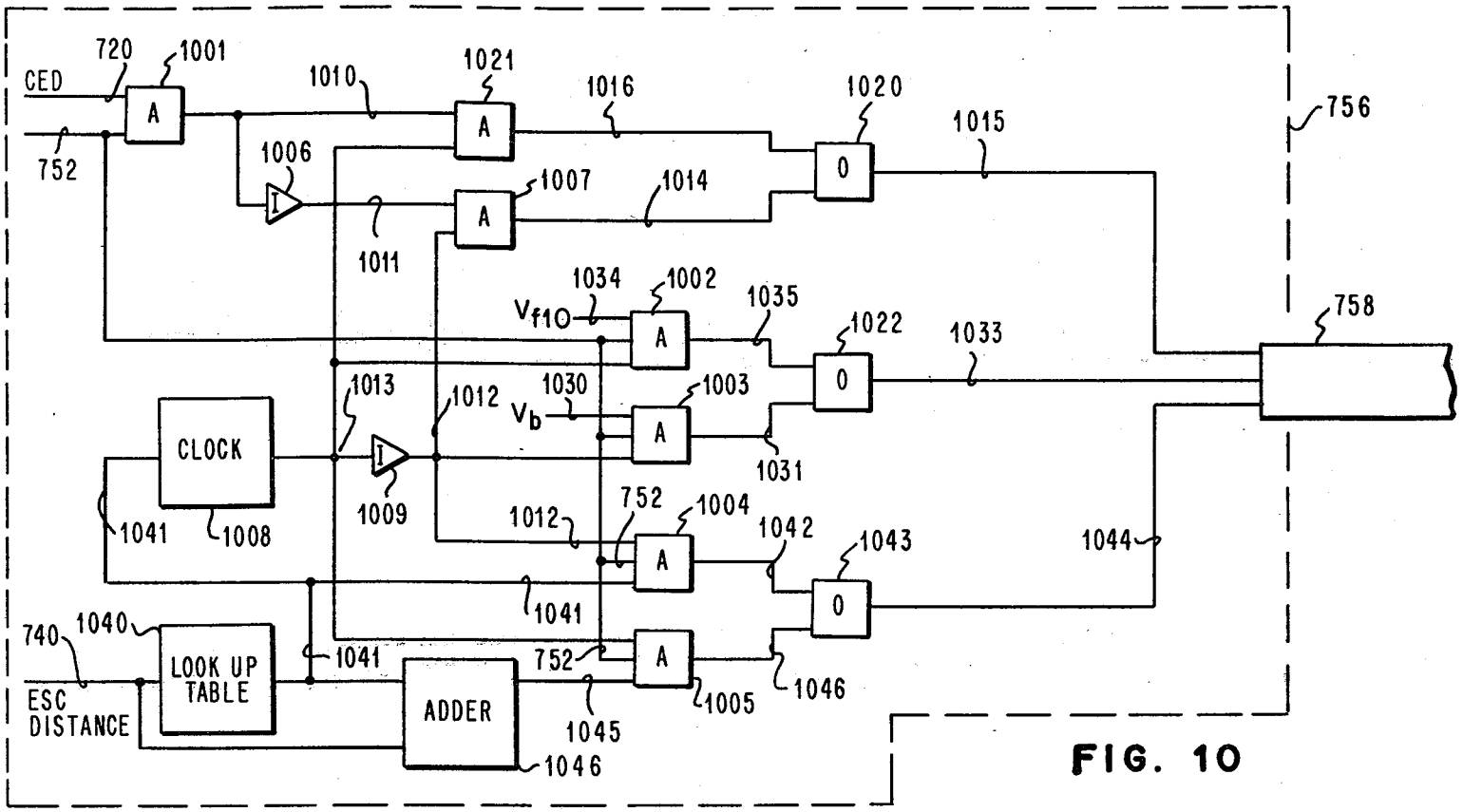
FIG. 10 shows the details of the sequence with the loop generator sequence represented at 756 in FIG. 7.

For cases 1 and 2, the carrier is required to take no turnaround when all directions are the same whether forward or reverse. The loop sequence described below with reference to FIG. 10 is a special case of this Table entry. Even though there is no net direction change, the loop is used to gain the required time associated with the aforementioned escapement constraints.

When the desired print direction and required direction are the same but differ from the current direction, as in cases 3 and 4, a single turnaround trailing type sequence is required. That means that an escapement turnaround sequence is followed by an escapement to the required print point.

When the desired print direction is opposite to that of both of the current escapement direction and the required escapement direction, a single turnaround leading action is taken as in cases 5 and 6. This means that there is an escapement to the print point followed by the application of an escapement turnaround sequence.

Lastly for cases 7 and 8, when the current carrier escapement direction and desired print direction are the same with the required direction being different, a double turnaround sequence is required. This sequence is a composite of two single turnaround sequences.

Figure 7:
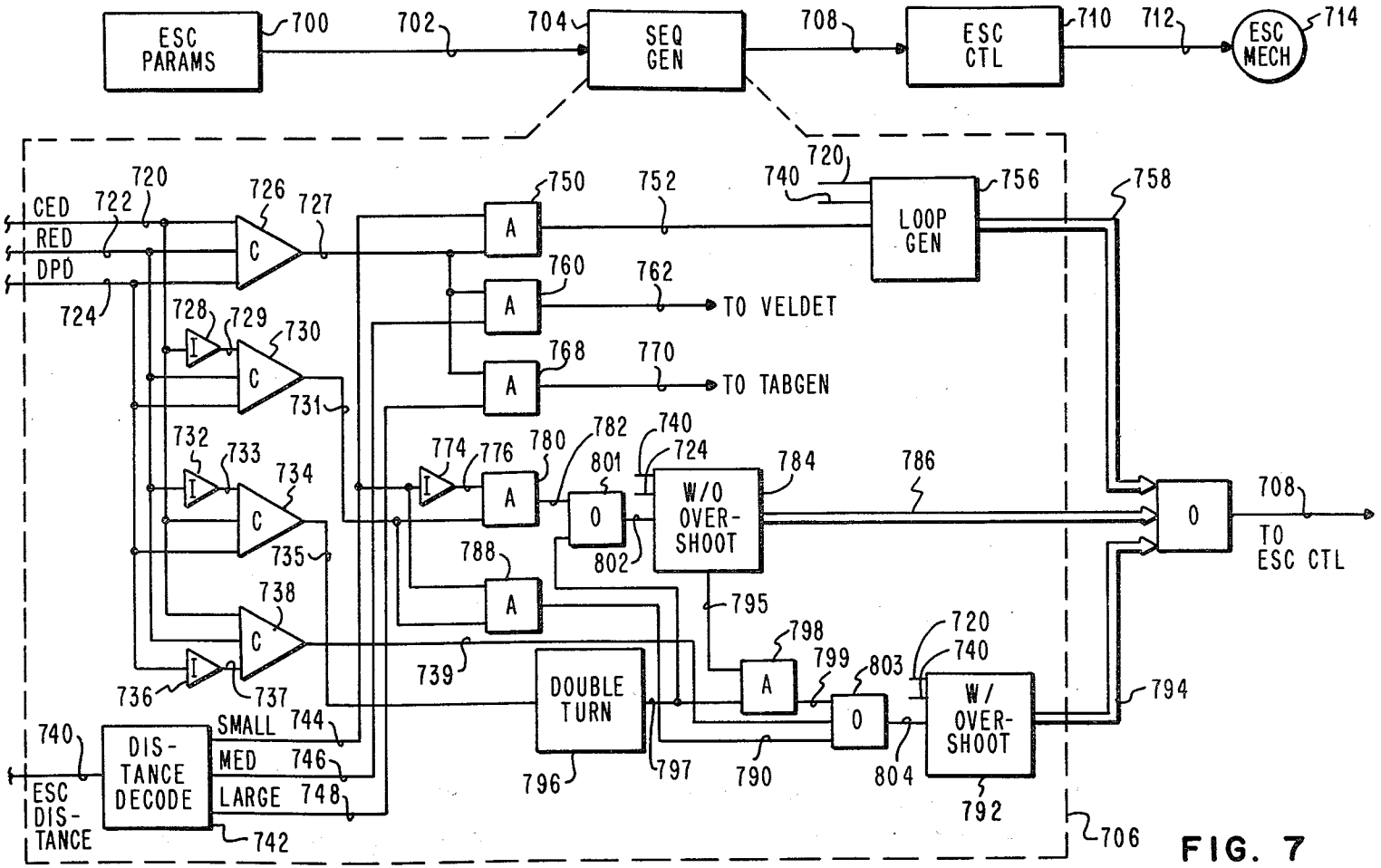
FIG. 7 is a more detailed block diagram of the sequence of the logic for generating the sequence as shown in FIGS. 3–6.

FIG. 7 is a block diagram illustrating the actions taken in the controls of the printer embodying our invention. More particularly, FIG. 7 shows the turnaround sequence generating logic for those sequences illustrated in FIGS. 3–6. Referring now to FIG. 7, escapement parameters input to the system in a conventional way by the user and include such information as represented at block 700. Those parameters are passed over line 702 to sequence generator logic 704. The detailed view of that logic is within the dotted lines 706. Output from the sequence generator is passed along line 708 to escapement control logic 710 which sends the necessary signal over line 712 to the escapement mechanism indicates generally at 714. The signals represented in lines 702, 708, and 712 are, in fact, a plurality of signals to be described below.

Included in the escapement parameters 700 are specific values such as escapement distance, current escapement distance direction, the required escapement direction, and the desired print direction. The distance to be escaped is on line 740. The current escape direction (CED) is on line 720, the required direction (RED) on line 722, and the desired print direction (DPD) on line 724. These three lines are input to comparator 726 for determining whether a sequence has the characteristics above defined for cases 1 and 2 in Table I. That is, current escapement direction, required direction and desired print direction must be in the same direction for cases 1 and 2.

Similarly, these three signals are input to other comparators for determining the other cases. Current escapement direction on line 720 is inverted by inverter 728 and the inverted signal placed along line 729 is input with signals on lines 722 and 724 to comparator 730 for determining whether this sequence will have the characteristics of case 3 or 4. That is for cases 3 and 4 CED must be opposite to the direction of RED and DPD.

In a like manner, the required escapement direction on line 722 is inverted by inverter 732 and the output placed on line 733 which, along with the signals on lines 720 and 724, is input to comparator 734 which determines whether the particular sequence defined by the escapement parameters has the characteristics ascribed to cases 7 or 8. Again, for cases 7 and 8, RED must be opposite to CED and DPD.

The required print direction on line 724 is inverted in inverter 736 with the output placed on line 737 which together with the required escapement direction on line 722 and the current escapement direction on line 720 are input to comparator 738 for determining whether case 5 or 6 has been defined. Again, here DPD must be in the opposite direction of RED.

The other escapement parameter is the distance to be escaped on line 740 which is decoded in distance decoder 742. Distance decoder 742 has three outputs on lines 744, 746, and 748, representing small, medium, and large escapement distances, respectively. These signals on lines 744, 746, and 748 are gating signals used with the output from the comparators 726, 730, 734, and 738. The small distance signal on line 744 and the output from comparator 726 on line 727 representing no turnaround are input to AND gate 750 whose output on line 752 activates loop generator 756. Loop generator 756, shown in detail in FIG. 10, outputs signals to escapement control on line 758 to cause the turnaround sequence illustrated in FIG. 5. Line 758 is actually a plurality of lines which dictate the velocity, direction, and distance of a given escapement and vary in accordance with the parameter values of the sequence as depicted in FIG. 5.

Line 727 is also an input to AND gate 760. The other input to AND gate 760 is the medium distance signal on line 746. Output from AND gate 760 on line 762 is passed to the velocity determination logic which is disclosed in pending application "Apparatus For Synchronizing Carrier Speed And Print Character Selection In On-The-Fly Printing", Ser. No. 053,678, filed June 29, 1979, and having C. W. Evans, Jr., et al. as inventors, assigned to the same assignee as the present invention. Line 727 is also an input to AND gate 768. The other input which is along line 748, the large distance signal, output from AND gate 768 on line 770 is passed along to logic for generating tabulation commands, a description of which is not given since it does not constitute part of the present invention.

Output from comparator 730 on line 731 representing single turnaround trailing is input to AND gate 780. The other input to AND gate 780 is the inverted small distance signal. The small distance signal on line 744 is inverted in inverter 744. The inverted small distance signal on line 776 is applied to AND gate 780. Output from AND gate 780 on line 782 flows through OR gate 801 is input to the turnaround without overshoot generator 784, described in detail in FIG. 8, on line 802 whose output signals on line 786 are passed to the escapement control logic to cause an action as illustrated in FIG. 3. Line 786 is actually a plurality of lines which dictate the velocity, direction, and distance of a given escapement and vary in accordance with the values of the sequence depicted in FIG. 3.

The turnaround without overshoot generator 784 has another output. The function complete signal on line 795 indicates that the sequence has been carried out.

Output from comparator 734 on line 735 representing double turnaround is input to the double turnaround generator 796 which has an output on line 797 which is another input signal to OR gate 801 which in turn activates the turnaround without overshoot generator 784 on line 802. Line 797 is also input to AND gate 798 which has the function complete signal on line 795 as its other input. AND gate 798 develops its output signal along line 799 which forms an input to the turnaround with overshoot generator 792, described in detail in FIG. 9, through OR gate 803 along line 804. Thus double turnaround generates a turnaround without overshoot followed by a turnaround with overshoot. This is the sequence of FIG. 6.

Output from comparator 738 on line 739 representing single turnaround leading is another input to the turnaround wih overshoot generator 792 through OR gate 803 along line 804.

The small distance signal on line 744 along with the signal on line 731 representing single turnaround trailing are input to AND gate 788. The output of AND gate 788 on line 790 forms an additional input to the turnaround with overshoot generator 792 through OR gate 803 along line 804. Its output on line 794 is passed through escapement control logic to cause the carrier to experience the turnaround sequence shown in FIG. 4. Line 794 is actually a plurality of lines which dictate the velocity, direction, and distance of a given escapement and vary in accordance with the values of the sequence depicted in FIG. 4.

Finally, the outputs from the loop generator 756, the turnaround with overshoot generator 792, and the turnaround without overshoot generator 784 along lines 758, 794, and 786, respectively, are OR'd together by gate 707 to form the input to the escapement control logic 710 along line 708.

Figures 8, 9:
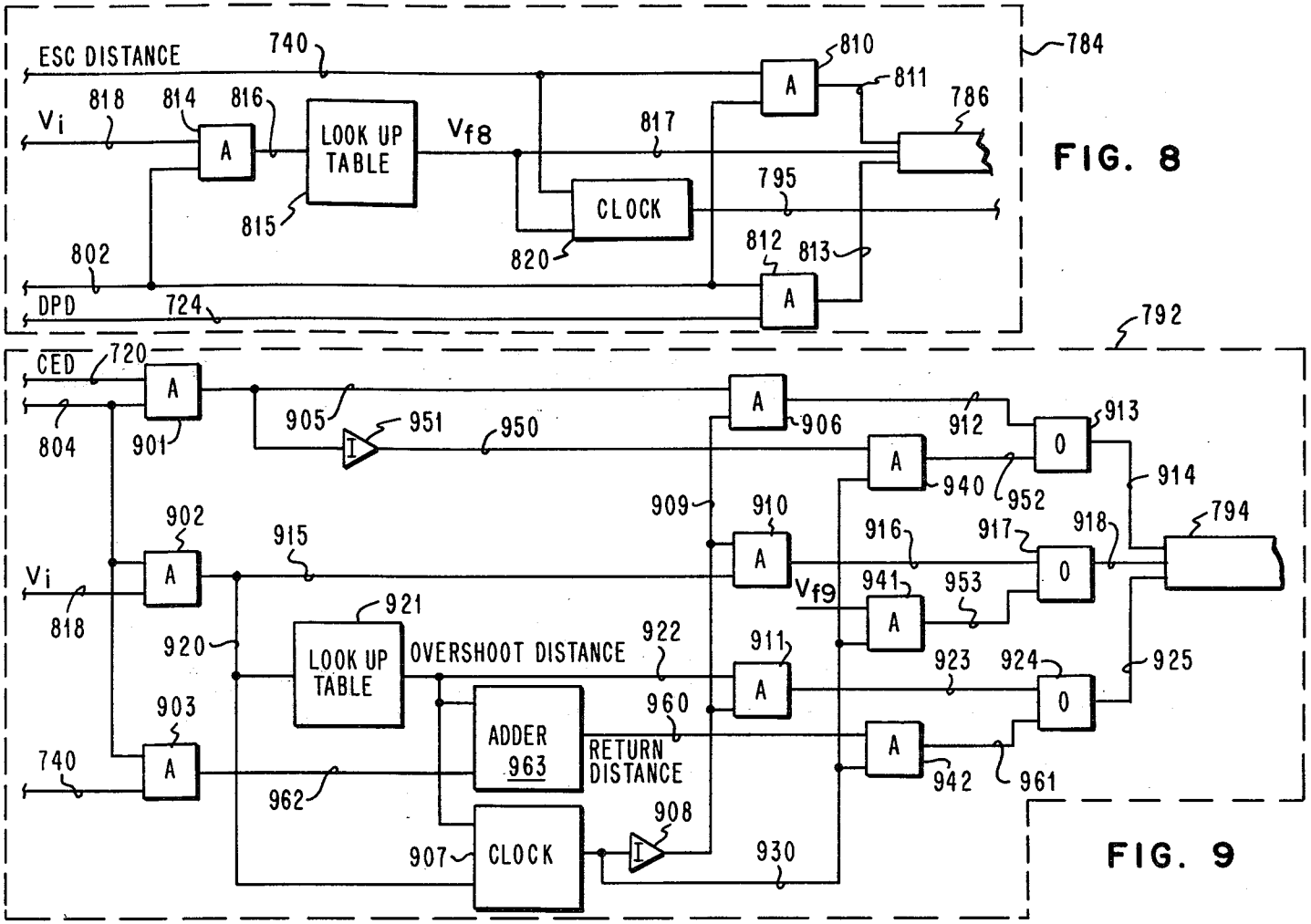
FIG. 8 is a more detailed diagram of turnaround without overshoot generator 784 from FIG. 7.
FIG. 9 is a more detailed diagram of turnaround with overshoot generator 792 in FIG. 7.

FIG. 8 shows details of the turnaround without overshoot sequence generator 784. The sequence is illustrated in FIG. 3. The escapement distance 740, FIG. 7, is one input to AND gate 810. The other is input line 802, FIG. 7, which is the activation line for this sequence generation. Therefore, when this sequence generator is activated, the escapement distance is passed along line 811 to the output 786 of this sequence generator 784, which is also shown in FIG. 7. The desired print direction signal 724, FIG. 7, is applied as one input to AND gate 812. The other input to AND gate 812 is line 802, which is the activation line for the sequence generator. Therefore, when the sequence generator 784 is activated, the escapement direction is passed along line 813 to the output line 786.

Line 802 is also applied to one input of AND gate 814. The other input along 818 is the velocity $v_i$ of the escapement device when print point 1 at 30 is reached in FIG. 3. When this sequence generator is activated, $v_i$ is passed along line 816 to the velocity look up table 815 which yields a value of the final velocity $v_{f8}$ which will be attained at print point 2 at 34 in FIG. 3. This value is passed along line 817 to the output of the sequence generator 786. $V_{f8}$ is also input to clock 820. The escape distance on line 740 is also input to the clock 820. The clock is set to timeout and places a signal at its output when the escapement dictated by the distance and velocity has been complete. This output along line 795 is also shown in FIG. 7 as the function complete line used as input to AND gate 798. When output 786 is applied to the escapement control 710, FIG. 7, the escapement sequence of FIG. 3 results.

It should be noted that the selection duration and index duration could also be used as vectors in the lookup table which would provide a finer degree of final velocity determination.

FIG. 9 depicts the details of the turnaround with overshoot sequence generator shown at 792 in FIG. 1. Line 804, FIG. 7, is the activation signal for this sequence generator. It is input to AND gates 901, 902, and 903.

The other input to gate 901 is the current escapement direction signal on line 720 which is also the direction of the overshoot to be generated by this circuit.

The output of gate 901 runs along line 905 to AND gate 906. The other input to gate 906 is from clock 907 via inverter 908 along line 909. Line 909 is active during the overshoot stage of the sequence and is also input to AND gates 910 and 911.

Returning now to AND gate 906, its output which represents the current print direction is passed along line 912 through OR gate 913 to line 914. This, in turn, forms the output 794 of the sequence generator which also appears in FIG. 7.

The second input of gate 902 is the velocity of the escapement at the time the first print point is reached $v_i$ on line 818 which represents the carrier velocity as print point 1 in FIG. 4. This is also the velocity of the carrier during overshoot to print 42 in FIG. 4. This velocity is passed along line 915 to AND gate 910 which has been activated by line 907. The carrier velocity $v_i$ on line 818 is therefore passed to the output of gate 910 on line 916 through OR gate 917 to line 918 and finally to the output 794 of this sequence generator.

The initial velocity on line 818 is also passed along line 920 to table look up mechanism 921. This mechanism yields a unique overshoot distance on line 922 which is dependent upon the input 920. This overshoot distance is passed to AND gate 911 which is activated by line 909. The overshoot distance is therefore applied to the output of 911 along 923, through OR gate 924 to line 925 and finally to the output 794 of the sequence generator.

The output of the table loop up mechanism 921 along 922 and the initial velocity along 920 are applied to the clock 907 which yields a signal at its output when the time to escape the overshoot distance (40–42 in FIG. 4) at $v_i$ the initial velocity has expired. This signal is applied through inverter 908 to AND gates 906, 910, and 911, these gates are deactivated, thus degating the overshoot distance, direction, and velocity from the output of the sequence generator 794.

At the same time, the output of clock 907 is applied along line 930 to AND gates 940, 941, and 942. The other input to 940 is line 950 from inverter 951. The input to this inverter is along line 905 which is the current or overshoot direction. Therefore, the opposite direction is applied to AND gate 940 which, being so conditioned, passes this direction information along line 952, through OR gate 913, along line 914 to sequence control output 794. Similarly, $v_{f9}$, the fixed final velocity for a turnaround with overshoot sequence, is applied as the second input to AND gate 941, and, being thusly conditioned, is passed along line 953, through OR gate 917, along line 918 to sequence control output 794.

The second input to AND gate 942 is the return distance for this sequence and is applied along line 960. Being so conditioned, the return distance is passed through AND gate 942, along line 961, through OR gate 924, along line 925, to sequence control output 794. The return distance is generated as a result of adding in ADDER 963 the overshoot distance along 922 and the distance between the two print points (40 and 44 in FIG. 4) which is applied on line 740 to AND gate 903 and finally along line 962. This addition is required since the distance between the two print points has been increased by the amount of the overshoot and must be accounted for when the turnaround is accomplished. This circuit, when activated, applies at the output 794 the distance, direction, and velocity of the overshoot, followed by the distance, direction, and velocity of the return escapement. When this information is applied to escapement control 710, FIG. 7, the escapement sequence depicted in FIG. 4 results.

It should be noted that the selection duration and index duration can also be used as vectors in the look up table which would provide a finer degree of overshoot distance determination.

FIG. 10 depicts the loop generator circuit 756 in FIG. 7. This circuit is similar to that used for the turnaround with overshoot sequence generator 792 shown in FIG. 9. One major difference is that the variable used to control the sequence is a function of the escape distance rather than the initial velocity.

The loop generator 756 activation line 752, FIG. 7, is also seen in FIG. 10 as input to AND gates 1001, 1002, 1003, 1004, and 1005. The other input to gate 1001 is the current escape direction along line 720. Therefore, when the loop generator is activated, the current escape direction is passed through gate 1001 to line 1010. This signal is inverted by inverter 1006 and passes along line 1011 to AND gate 1007. The other input to gate 1007 is along line 1012 which is the inverted output of the clock 1008 along line 1013 through inverter 1009. The clock 1008 will become active following the time t takes to travel the distance from print point 1 at 50 to print point 2 at 52 on FIG. 5. Since the clock 1008 is not active initially, the inverted clock signal along line 1012 is up and activates AND gate 1007 and allows the inverse of the current escapement direction to pass to line 1014, through OR gate 1020, along line 1015 to the output 758 of the loop generator.

Now, when the clock 1008 becomes active, line 1012 becomes inactive and the inverse escape direction no longer passes to the output 758. However, line 1013 is active and is presented as input to AND gate 1021. The other input to this gate is the current escapement direction along line 1010. Being so conditioned, the current escapement direction passes through gate 1021, along line 1016 through OR gate 1020, and long line 1015 to the output 758 of the loop generator as shown in FIG. 5.

Examining the inputs to AND gate 1003, one input, along line 1030, is the fixed velocity $v_b$ used in the reverse direction of the loop escapement sequence, the second input is along 752 and has been described earlier as the activation signal, the third is along line 1012 and has been shown to be the inverter output of the clock which is active during the reverse portion of the loop sequence from point 50 to point 54 of FIG. 5. Being so conditioned, the velocity, $V_b$, is passed through gate 1003 along line 1031 through OR gate 1022 and along line 1033 to loop generator output 758. When the clock 1008 becomes active, line 1012 become inactive, thus deactivating gate 1003 and $V_b$ is no longer passed to the output 758.

However, line 1013 is active and is presented as an input to AND gate 1002. A second input along line 752 is the activation signal previously discussed. A third input to gate 1002 is along line 1034 and represents the fixed final velocity $v_f$ to be obtained in the loop sequence shown in FIG. 5. Being so conditioned, the final velocity is passed through gate 1002, along line 1035, through OR gate 1022, and along line 1033 to loop generator output 758. Therefore, the circuit shown in FIG. 10 presents the velocities $v_b$ and $v_f$ to the output of the loop generator in a sequence required to support the loop shown in FIG. 5.

Now, the escape distance, the distance between points 50 and 52, FIG. 5, is present along line 740 which also appears on FIG. 7. This signal is presented to table look up 1040. This table yields the escapement distance to be travelled between points 50 and 54 of FIG. 5. This value is present on line 1041. Line 1041 is input to the clock which conditions the clock to time out (activate) when the time to travel this distance has expired. Line 1041 is also on input to AND gate 1004. A second input to gate 1004 is the activation signal along line 752 which has been previously discussed. A third input to gate 1004 is the inverted clock output along line 1012. Being so conditioned, the distance obtained from look up table 1040 is passed through gate 1004, along line 1042, through OR gate 1043 and along line 1044 to loop generator output 758. When the clock becomes active, line 1012 becomes inactive, thus blocking the transfer of the table generated escape distance from passing to the output 758.

However, line 1013 is active and is present as one input to AND gate 1005. A second input to gate 1005 is the previously discussed activate signal along line 752. A third input to gate 1005 is along 1045. This line is the output of ADDER 1046. This ADDER yields the sum of the escape distance (50 to 52, FIG. 5) presented along line 740, and the table generated escape distance (50 to 54, FIG. 5) along line 1041. That is, the distance 54 to 52, FIG. 5, is present at the output of the ADDER along line 1045. Therefore, this distance is passed through AND gate 1005, along line 1046, through OR gate 1043, and along line 1044 to loop generator 758. The escapement distances required to support the loop sequence shown in FIG. 5 are presented to the output 758.

In summary, the above described means will generate a loop escapement sequence along line 758 when the distance between two print points is small yet there is no required change in print direction. Additionally, a turnaround without overshoot escapement sequence will be generated when the distance between the two print points is medium or large, a change in print direction is required, and the direction from print point 1 to print point 2 is opposite to the direction of escapement when print point 1 is reached.

A turnaround with overshoot sequence is also generated when (1) the distance between the two print points is small, a change in print direction is required, and the direction from print point 1 to print point 2 is opposite to the direction of escapement when print point 1 is reached, and (2) a change in print direction is required and the direction from print point 1 to print point 2 is in the same direction as the direction of escapement when print point 1 is reached. Finally, a complex double turnaround sequence, consisting of, first a turnaround without overshoot and, second, a turnaround with overshoot, is generated when there is to be no change in the direction of print. However, the direction from print point 1 to print point 2 is opposite to the direction of print.

While the invention has been particularly shown and described with reference to one embodiment, it will be understood by those skilled in the art that various changes in implementation, form, and detail may be made without departing from the spirit and scope of the invention.

We claim:

1. In a high speed, bidirectional, on-the-fly printer, including a means for character selection, an improved method for controlling the direction and velocity of the print element carrier during printing of the portions of complex characters characterized by moving the carrier past a print position and printing the first portion of a character;

twice reversing the direction of carrier motion while controlling carrier velocity so that the duration of carrier motion is substantially the same as the time needed for selection of the next character portion to be printed; and moving the carrier again past the same print position and printing the next portion of the character.

2. The method of claim 1 wherein said step of twice reversing further includes (a) decreasing carrier velocity over a first distance;

(b) reversing carrier direction;

(c) incresing carrier velocity to a constant value;

(d) decreasing carrier velocity over a second distance;

(e) reversing carrier direction; and (f) increasing carrier velocity to a final velocity.

3. The method of claim 2 wherein the final velocity reached by the carrier is determined as a function of the initial velocity.

4. In a high speed printer for outputting preformatted text improved carrier control during printing of complex characters including:

means for printing a portion of a character while the carrier is moving in a first direction past a print position;

means for twice reversing the direction of carrier motion;

means for varying the velocity at which the carrier is moving in both the first and reverse direction to provide adequate time for the selection of the remaining portion of the character; and means for printing the remaining portion of the character while the carrier is again moving past the same print position.

5. A process for printing complex characters such as overstrikes, underscores, and accented symbols in a preformatted text stream using a high speed, bidirectional printer including a print element carrier characterized in:

printing a first portion of a complex character at a given print location while the print element carrier is moving;

reversing the direction of the print element carrier;

varying the velocity of the print element carrier during the direction reversing to provide sufficient time for the selection of the remaining portion of the complex character;

moving the print element carrier again past the given print location; and printing the other portion of the complex character while the print element carrier is moving and before printing at another print location.

6. The process of claim 5 wherein said moving step includes twice reversing the direction of the print element carrier.

7. The process of claims 5 or 6 further including determing the velocity profile of said moving step as a function of initial carrier velocity.

8. An improved method of controlling print element carrier velocity in a bidirectional printer characterized in twice reversing the direction of the print element carrier motion between points of printing consecutive symbols when the carrier is not at a margin location, and determining characteristics of the reversing action as a function of the initial print element carrier velocity, the horizontal distance between the consecutive symbols, and the direction of separation of the consecutive symbols thereby providing adequate time for the selection of the next symbol to be printed.

* * * * *

UNITED STATES PATENT AND TRADEMARK OFFICE

CERTIFICATE OF CORRECTION

PATENT NO. : 4,410,286

DATED : 18 October 1983

INVENTOR(S) : E.Y. Ko and R.A. Pascoe

It is certified that error appears in the above-identified patent and that said Letters Patent are hereby corrected as shown below:

Column 11, line 3 delete "loop" and insert therefor --look--.

Signed and Sealed this

*Twentieth* Day of *December 1983*

[SEAL]

*Attest:*

GERALD J. MOSSINGHOFF

*Attesting Officer*

*Commissioner of Patents and Trademarks*